US006413377B1

(12) United States Patent
Wright

(10) Patent No.: US 6,413,377 B1
(45) Date of Patent: Jul. 2, 2002

(54) DOUBLE LAYER PAPERMAKING FORMING FABRIC

(75) Inventor: Walter P. Wright, Larsen, WI (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 09/704,344

(22) Filed: Nov. 2, 2000

Related U.S. Application Data

(60) Provisional application No. 60/164,347, filed on Nov. 9, 1999.

(51) Int. Cl.[7] ..... D21F 1/00; D03D 11/00

(52) U.S. Cl. ..... 162/903; 139/383 A

(58) Field of Search ..... 162/348, 903; 139/383 A, 38 AR, 425 A; 428/116, 222, 229, 257

(56) References Cited

U.S. PATENT DOCUMENTS

| | | | | |
|---|---|---|---|---|
| 2,207,609 A | | 7/1940 | Buchanan | 139/425 |
| 2,659,958 A | | 11/1953 | Johnson | 28/80 |
| 3,575,752 A | | 4/1971 | Carpenter | 156/73 |
| 3,885,603 A | | 5/1975 | Slaughter | 156/73.1 |
| 4,373,979 A | | 2/1983 | Planeta | 428/257 |
| 4,515,853 A | | 5/1985 | Borel | 428/257 |
| 4,529,013 A | | 7/1985 | Miller | 139/383 A |
| 4,798,760 A | | 1/1989 | Diaz-Kotti | 428/234 |
| 4,945,952 A | | 8/1990 | Vöhringer | 139/383 A |
| 5,013,330 A | | 5/1991 | Durkin et al. | 51/297 |
| 5,025,839 A | | 6/1991 | Wright | 139/383 A |
| 5,066,532 A | | 11/1991 | Gaisser | 428/137 |
| 5,085,917 A | | 2/1992 | Hodnett, III | 428/173 |
| 5,238,536 A | | 8/1993 | Danby | 162/202 |
| 5,421,374 A | | 6/1995 | Wright | 139/383 A |
| 5,490,543 A | | 2/1996 | Fujisawa | 139/383 A |
| 5,503,196 A | | 4/1996 | Josef et al. | 139/383 A |
| 5,508,094 A | | 4/1996 | McCarthy et al. | 428/225 |
| 5,555,917 A | | 9/1996 | Quigley | 139/383 A |
| 6,073,661 A | * | 6/2000 | Wilson | 139/363 A |
| 6,112,774 A | * | 9/2000 | Wilson | 139/383 A |
| 6,253,796 B1 | * | 7/2001 | Wilson et al. | 139/383 A |
| 6,276,402 B1 | * | 8/2001 | Herring | 139/383 A |

* cited by examiner

*Primary Examiner*—Dean T. Nguyen
(74) *Attorney, Agent, or Firm*—Volpe and Koenig, P.C.

(57) ABSTRACT

A double layer papermaking fabric having twice as many paper side cross machine direction yarns as machine side cross machine direction layer. A system of machine direction yarns is interwoven with both cross machine direction layers, with each machine direction yarn forming first and second knuckles on each side of the fabric. The paper side knuckles are woven with uniform spacing and each machine side cross machine direction yarn is passed under by two machine direction knuckles spaced by at least one intermediate machine direction yarn.

18 Claims, 7 Drawing Sheets

| | 60 | 61 | 62 | 63 | 64 | 65 | 66 | 67 | 68 | 69 | 70 | 71 | 72 | 73 | 74 | 75 | 76 | 77 | 78 | 79 |
|---|---|---|---|---|---|---|---|---|---|---|---|---|---|---|---|---|---|---|---|---|
| 20 | X | - | - | - | - | - | - | - | - | - | - | X | - | - | - | - | - | - | - | - |
| 21 | - | - | - | X | - | - | - | - | - | - | - | - | - | - | X | - | - | - | - | - |
| 22 | - | - | - | - | - | - | X | - | - | - | - | - | - | - | - | - | - | X | - | - |
| 23 | X | - | - | - | - | - | - | - | - | X | - | - | - | - | - | - | - | - | - | - |
| 24 | - | - | - | X | - | - | - | - | - | - | - | - | X | - | - | - | - | - | - | - |
| 25 | - | - | - | - | - | - | X | - | - | - | - | - | - | - | - | X | - | - | - | - |
| 26 | - | - | - | - | - | - | - | - | - | X | - | - | - | - | - | - | - | - | X | - |
| 27 | - | X | - | - | - | - | - | - | - | - | - | - | X | - | - | - | - | - | - | - |
| 28 | - | - | - | - | X | - | - | - | - | - | - | - | - | - | - | X | - | - | - | - |
| 29 | - | - | - | - | - | - | - | X | - | - | - | - | - | - | - | - | - | - | X | - |
| 30 | - | X | - | - | - | - | - | - | - | - | X | - | - | - | - | - | - | - | - | - |
| 31 | - | - | - | - | X | - | - | - | - | - | - | - | - | X | - | - | - | - | - | - |
| 32 | - | - | - | - | - | - | - | X | - | - | - | - | - | - | - | - | X | - | - | - |
| 33 | - | - | - | - | - | - | - | - | - | - | X | - | - | - | - | - | - | - | - | X |
| 34 | - | - | X | - | - | - | - | - | - | - | - | - | - | X | - | - | - | - | - | - |
| 35 | - | - | - | - | - | X | - | - | - | - | - | - | - | - | - | - | X | - | - | - |
| 36 | - | - | - | - | - | - | - | - | X | - | - | - | - | - | - | - | - | - | - | X |
| 37 | - | - | X | - | - | - | - | - | - | - | - | X | - | - | - | - | - | - | - | - |
| 38 | - | - | - | - | - | X | - | - | - | - | - | - | - | - | X | - | - | - | - | - |
| 39 | - | - | - | - | - | - | - | - | X | - | - | - | - | - | - | - | - | X | - | - |

FIG. 23

| | 60 | 61 | 62 | 63 | 64 | 65 | 66 | 67 | 68 | 69 | 70 | 71 | 72 | 73 | 74 | 75 | 76 | 77 | 78 | 79 |
|---|---|---|---|---|---|---|---|---|---|---|---|---|---|---|---|---|---|---|---|---|
| 40 | X | X | X | X | X | X | X | - | X | - | X | X | X | X | X | X | - | X | - | X |
| 41 | X | X | - | X | - | X | X | X | X | X | X | X | X | - | X | - | X | X | X | X |
| 42 | X | - | X | X | X | X | X | X | - | X | - | X | X | X | X | X | X | X | X | - |
| 43 | X | X | X | X | X | - | X | - | X | X | X | X | X | X | - | X | - | X | X | X |
| 44 | - | X | - | X | X | X | X | X | X | X | X | - | X | - | X | X | X | X | X | X |
| 45 | X | X | X | X | X | X | - | X | - | X | X | X | X | X | X | X | X | - | X | - |
| 46 | X | X | X | - | X | - | X | X | X | X | X | X | - | X | - | X | X | X | X | X |
| 47 | - | X | X | X | X | X | X | X | X | - | X | - | X | X | X | X | X | X | - | X |
| 48 | X | X | X | X | - | X | - | X | X | X | X | X | X | X | X | - | X | - | X | X |
| 49 | X | - | X | - | X | X | X | X | X | X | - | X | - | X | X | X | X | X | X | X |

FIG. 24

DOUBLE LAYER PAPERMAKING FORMING FABRIC

CROSS REFERENCE TO RELATED APPLICATIONS

This application claims the benefit of provisional application 60/164,347, filed Nov. 9, 1999.

BACKGROUND

This invention relates generally to papermaking fabrics. It relates more specifically to papermaking fabrics used in the forming section of a papermaking machine.

Papermaking machines transform an aqueous slurry of fibers into a continuous paper web which can be processed for a variety of end uses. Papermaking fabrics are employed throughout the papermaking process to transport the web of paper as a continuous sheet through the papermaking equipment.

The papermaking process starts in the forming section of a papermaking machine where the aqueous slurry is deposited onto a forming fabric having the desired characteristics for retaining the fibers while allowing the water to pass through. The wet paper web created by this process is then carried by a press fabric through the press section where additional water is removed by squeezing the paper web and fabric between two rolls. The paper web is then carried through the drying section on a dryer fabric to remove additional water through forced evaporation. The design of papermaking fabrics used on each section of a papermaking machine vary in accordance with function.

In the forming section of papermaking machines, the fibers are retained and collected on the upper surface of a forming fabric and formed into a paper sheet. The forming fabric must have a fine mesh weave on the paper contact side in order to avoid marking the paper and to support the fiber from the slurry. The fabric must also have good drainage characteristics for initial water removal to facilitate paper formation. However, as previously noted, the forming fabric also serves as a drive belt and is subjected to high tensile loads in the machine direction and compressive or buckling loads in the cross machine direction. Therefore, a single fine-mesh yarn system is generally not suitable for use as a forming fabric.

To combat prior art problems, multi-layer forming fabrics were developed with fine-mesh yarn on the paper forming surface to facilitate paper formation, and larger yarns on the machine contact side to provide strength and longevity. Example multi-layer forming fabrics include U.S. Pat. No. 4,709,732 which discloses a dual layer forming fabric for use in the paper making process and U.S. Pat. No. 4,606,585 which discloses a two-ply forming fabric with a two-shaft, twill or satin weave pattern. U.S. Pat. No. 5,025,839 discloses a two-ply forming fabric with zig-zagging machine direction yarns which provides improved drainage. U.S. Pat. No. 5,857,498 also discloses a two-ply forming fabric which claims to include zig-zagging machine direction yarns. Both of the later fabrics include nonuniformly spaced paper side knuckles which may result in uneven spacing of the cross machine direction yarns and a configuration referred to as "twinning", both of which can result in uneven drainage and a nonuniform paper product. Additionally, each of these fabrics has a twill bottom surface which may result in "guiding" of the fabric on the papermaking machine.

SUMMARY

The present invention relates to a double layer papermaking fabric preferably for use in the forming section of a papermaking machine. The fabric has a paper side cross machine direction layer having twice as many yarns as the machine side cross machine direction layer. A system of machine direction yarns is interwoven with both cross machine direction layers, with each machine direction yarn forming first and second knuckles on each side of the fabric. The paper side knuckles are uniformly spaced to reduce the likelihood of "twinning". Each machine side cross machine direction yarn is passed under by two machine direction knuckles spaced by at least one intermediate machine direction yarn, thereby producing a machine direction yarn zig zag effect on the machine side of the fabric to provide improved drainage.

BRIEF DESCRIPTION OF THE DRAWINGS

FIG. 23 is a paper side weave pattern diagram for the fabric of FIG. 1.

FIG. 24 is a machine side weave pattern diagram for the fabric of FIG. 1.

DETAILED DESCRIPTION OF THE PREFERRED EMBODIMENTS

Figure 1:
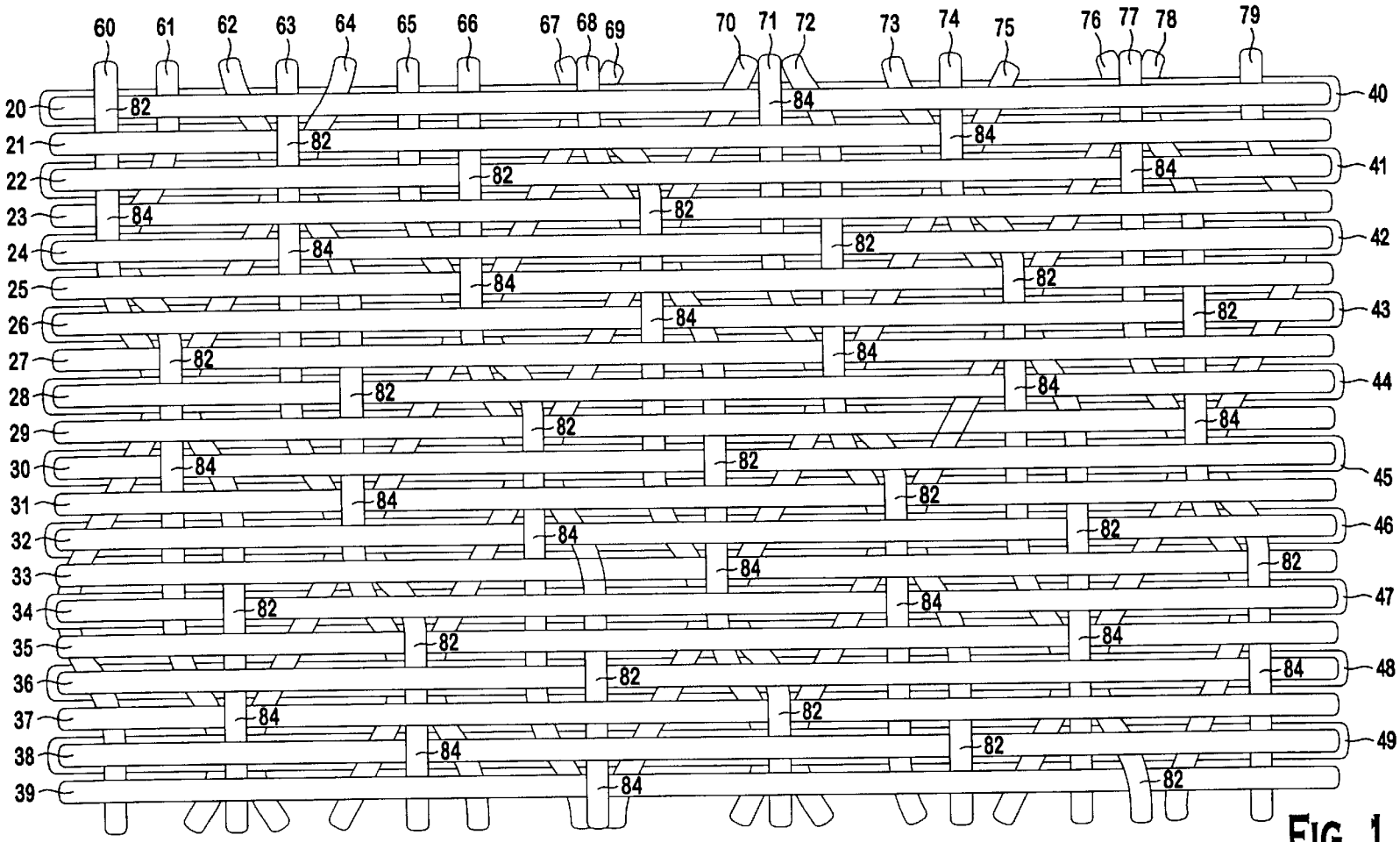
FIG. 1 is a paper side plan view of the preferred embodiment of the present invention.

The preferred embodiments will be described with reference to the drawing figures wherein like numerals identify like elements.

Figure 2:
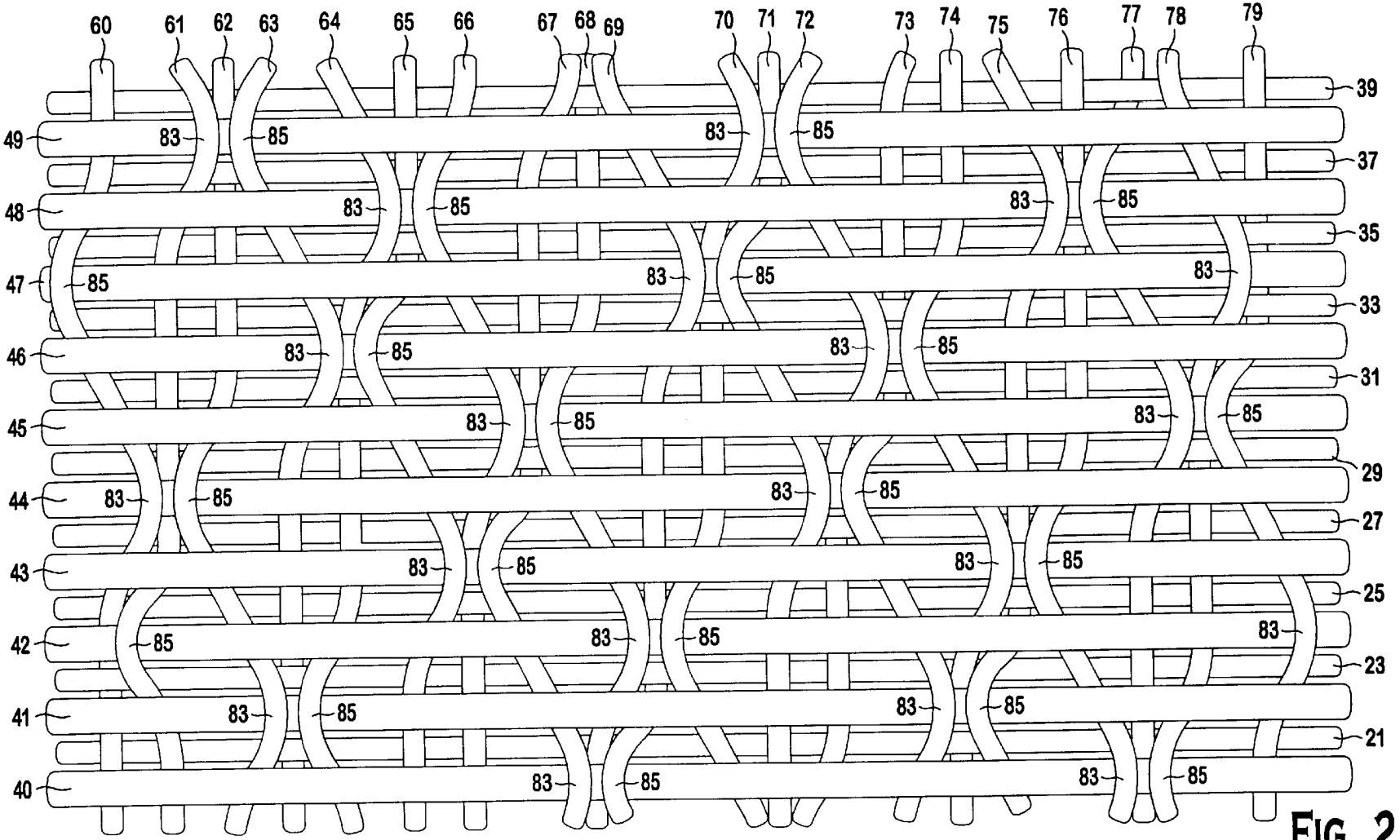
FIG. 2 is a machine side plan view of the fabric of FIG. 1.

Referring to FIGS. 1 and 2, there is shown a fabric 1 in accordance with the preferred embodiment of the present invention. The fabric 1 is comprised of a top layer 12 of cross machine direction (CMD) yarns 20–39, and a bottom layer 15 of CMD yarns 40–49. The top and bottom CMD layers 12 and 15 are interwoven with a system of machine direction (MD) yarns 60–79 in a repeated pattern.

As will be appreciated by those skilled in the art, papermaking fabrics may be woven endless or may be flat woven and then seamed to form an endless belt. In and endlessly woven fabric, the warp yarns in the loom become the CMD yarns with respect to the orientation of the fabric on a papermaking machine. In a fabric which is woven flat, the warp yarns on the loom become the MD yarns with respect to the orientation of the fabric on the papermaking machine. The techniques for endlessly weaving or flat weaving and seaming a papermaking fabric are well known in the art and the fabric of the present invention can be endlessly or flat woven. To reduce the likelihood of confusion, the description will be made only with reference to the orientation of the fabric on the papermaking machine and the yarns will be referred to as MD and CMD.

In the preferred embodiment, the fabric 1 is woven with twice as many yarns in the upper CMD layer 12 than in the lower CMD layer 15. Twenty MD yarns 60–79 interweave with twenty upper layer CMD yarns 20–39 and ten lower layer CMD yarns 40–49.

Figures 3, 4, 5, 6, 7:
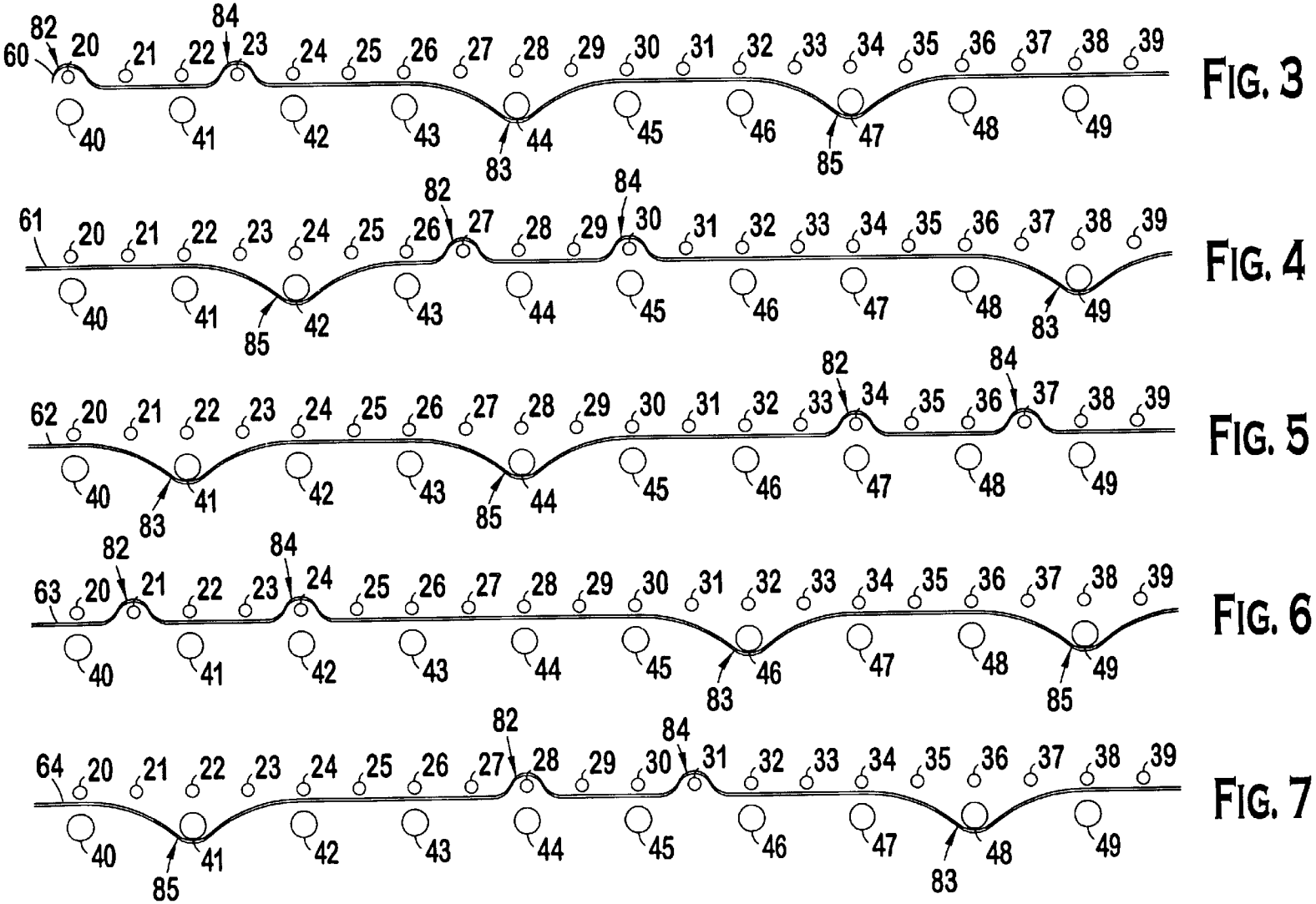
FIGS. 3–22 are schematic diagrams depicting the weave pattern of each of the twenty machine direction yarns of a repeat interweaving with the cross machine direction yarn layers of the fabric of FIG. 1.
Figures 8, 9, 10, 11, 12:
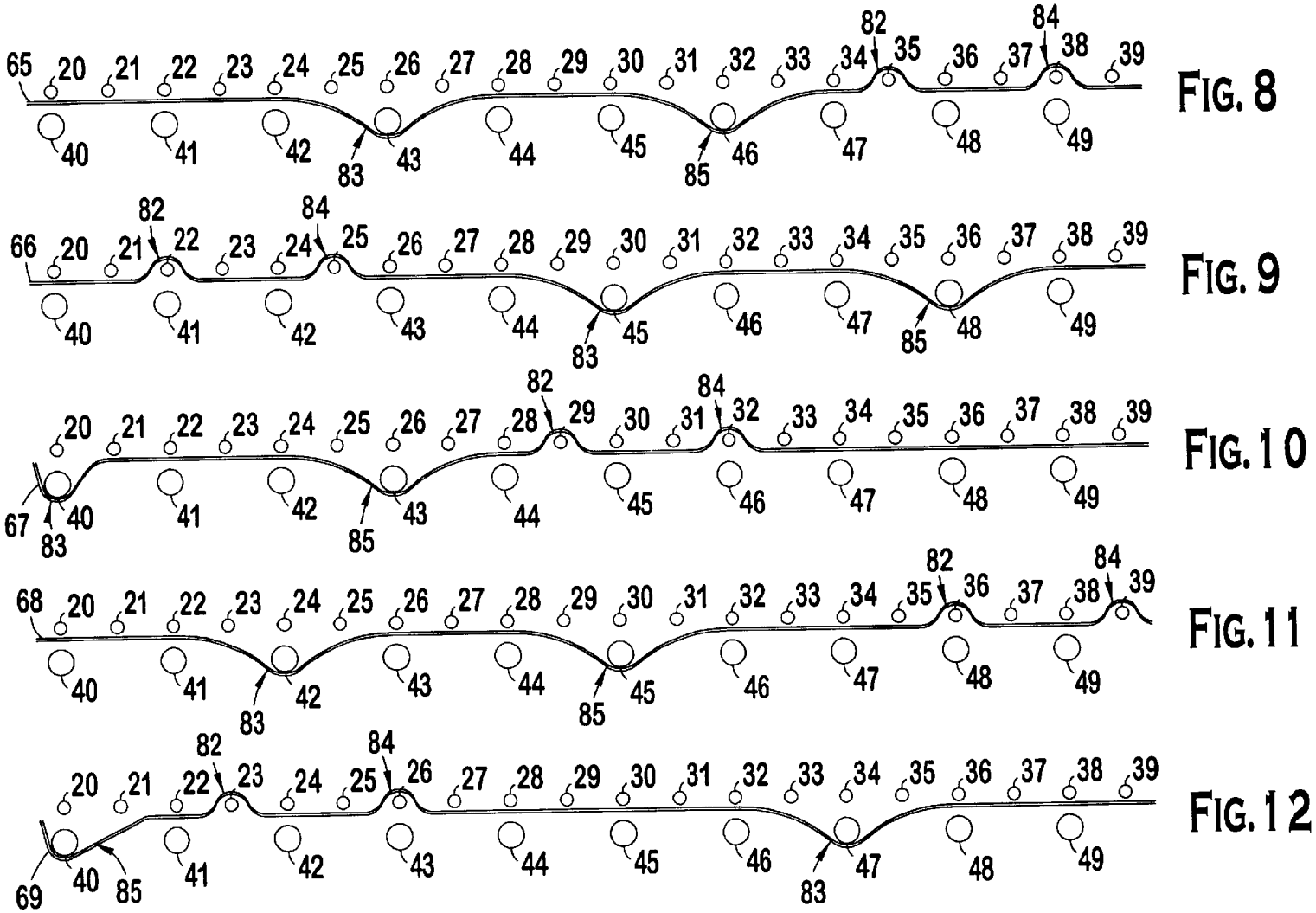
Figure 13:
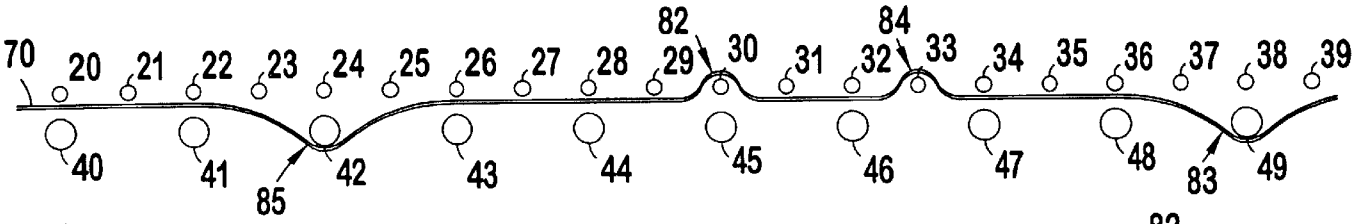
Figure 14:
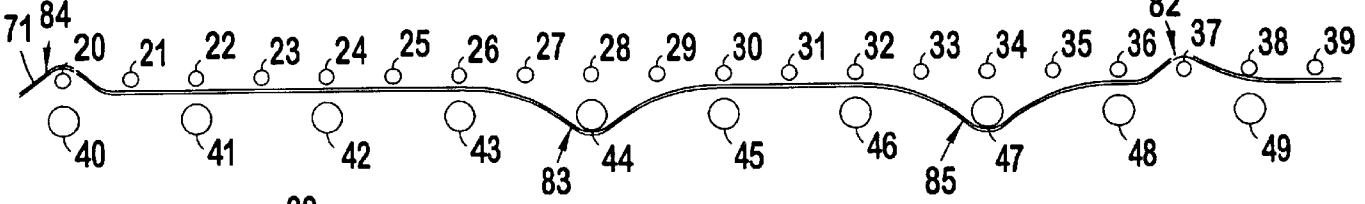
Figure 15:
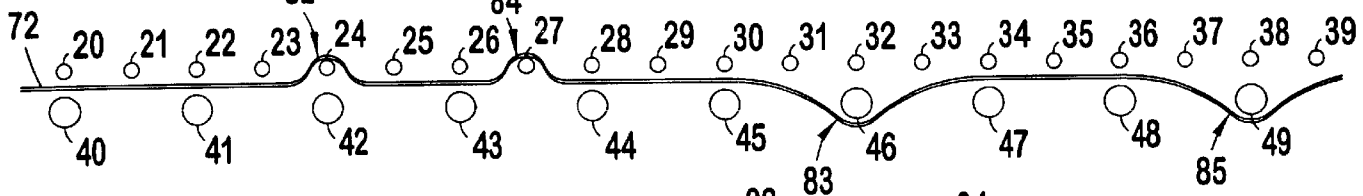
Figure 16:
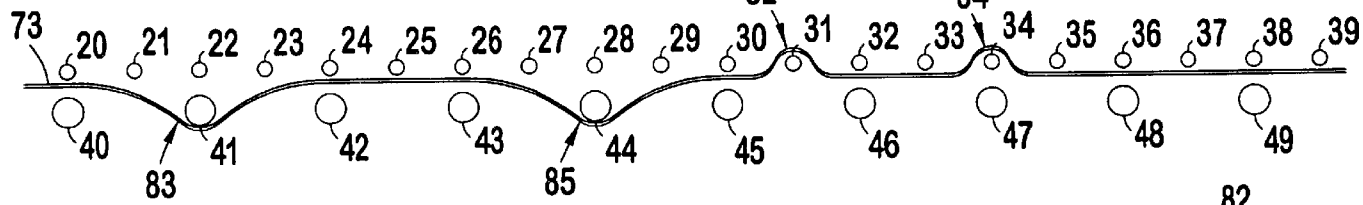
Figure 17:
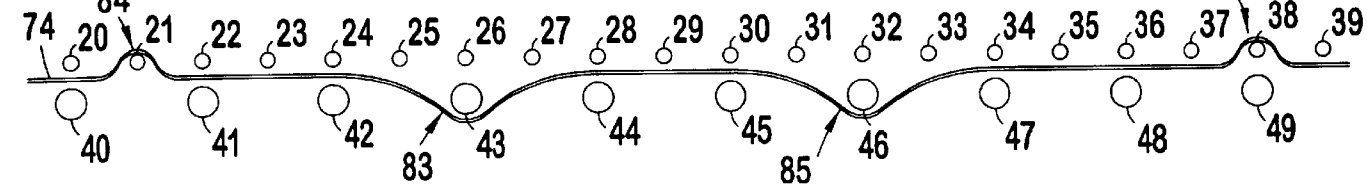
Figure 18:
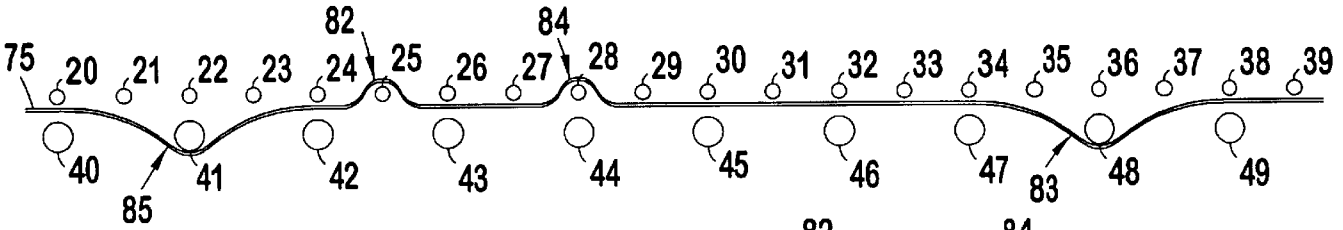
Figure 19:
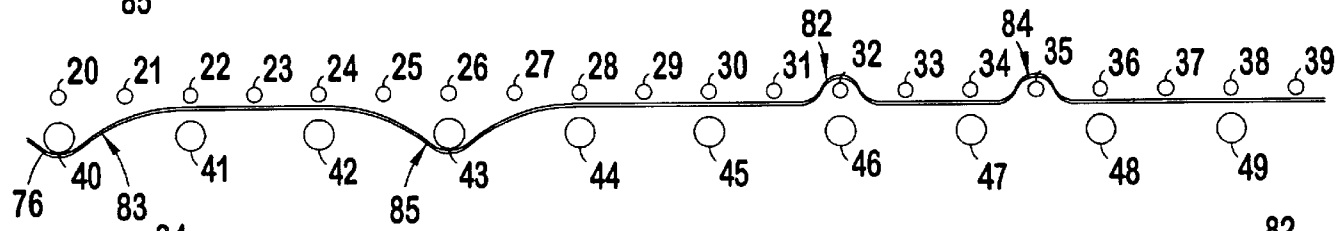
Figure 20:
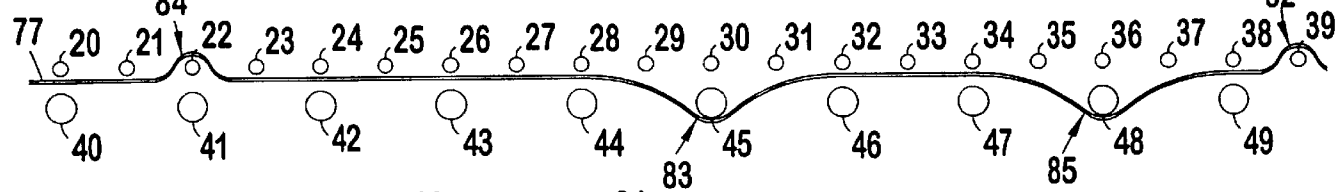
Figure 21:
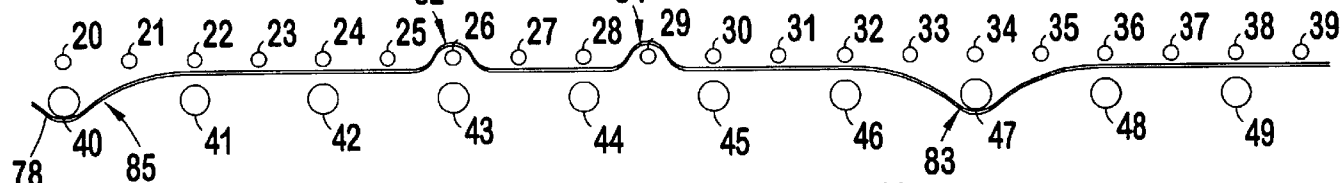
Figure 22:
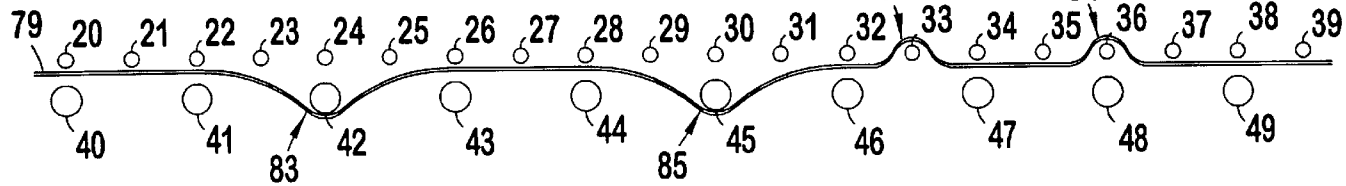

Each MD yarn 60–79 generally weaves with two paper side knuckles 82 and two machine side knuckles 84. The MD yarns 60–79 weave in two patterns with the CMD yarn layers 12 and 15. MD yarns 20, 22, 24, 26, 28, 30, 32, 34, 36, and 38 weave in a first pattern and MD yarns 21, 23, 25, 27, 29, 31, 33, 35, 37 and 39 weave in a second pattern. The weave pattern of each MD yarn 60–79 of the preferred embodiment is shown in FIGS. 3–22. The first MD yarn weave pattern is illustrated by MD yarn 60 as shown in FIG. 3. MD yarn 60 weaves over upper layer CMD yarn 20 to form first paper side knuckle 82, under upper layer CMD yarns 2 land 22, over paper side CMD yarn 23 to form second paper side knuckle 84, between the upper and lower CMD layers 12 and 15, under lower layer CMD yarn 44 to form first machine side knuckle 83, between the upper and lower CMD layers 12 and 15, under lower layer CMD yarn 47 to form second machine side knuckle 85, and between the upper and lower CMD layers 12 and 15 before repeating the pattern again. In this first pattern, the second paper side knuckle 84 is spaced from the first machine side knuckle 83 by two lower layer CMD yarns 42, 43.

The second MD yarn weave pattern is illustrated by MD yarn 61 as shown in FIG. 4. MD yarn 61 weaves between the upper and lower CMD layers 12 and 15, under lower layer CMD yarn 42 to form first machine side knuckle 83, between the upper and lower CMD layers 12 and 15, over upper layer CMD yarn 27 to form first paper side knuckle 82, under upper layer CMD yarns 28 and 29, over paper side CMD yarn 30 to form second paper side knuckle 84, between the upper and lower CMD layers 12 and 15, and under lower layer CMD yarn 49 to form second machine side knuckle 85 before repeating the pattern again. In this second pattern, the second paper side knuckle 84 is spaced from the first machine side knuckle 83 by three lower layer CMD yarns 46–48.

Referring to FIGS. 23 and 24, paper side and machine side weave pattern diagrams are shown. In each weave pattern diagram, an "X" represents a point where the MD yarn weaves over the corresponding CMD yarn and a "-" represents a point where the CMD yarn weaves over the corresponding MD yarn. In FIG. 23, each "X" represents a MD yarn paper side knuckle. In FIG. 24, each "-" represents a MD yarn machine side knuckle.

Referring to FIGS. 1 and 23, it can be seen that the MD paper side knuckles of the preferred fabric 1 are uniformly spaced in the CMD. For example, the first paper side knuckle 82 of MD yarn 63 is spaced in a first CMD direction from the first knuckle 82 of MD yarn 60 by two MD yarns 61, 62, and is spaced in the opposite CMD direction from the first knuckle 82 of MD yarn 66 by two MD yarns 64, 65. This uniform spacing reduces the likelihood of uneven upper layer CMD yarn spacing and of "twinning". Other spacing, for example three upper layer CMD yarns, may also be used while maintaining the uniform spacing.

Additionally, the paper side surface has a diminished twill line. For example, moving from the first knuckle 82 of MD yarn 60 to the first knuckle 82 of MD yarn 63 is a progression down one CMD yarn and to the right three MD yarns, similar to the twill line of a five-shed satin weave. This diminished twill line allows paper webs to be produce with a finer finish.

Furthermore, each upper layer CMD yarn 20–39 includes a float over ten MD yarns and float over eight MD yarns. For example, CMD yarn 20 floats over MD yarns 61–70 and MD yarns 72–79. The long floats further enhance the support surface for the paper web.

Referring to FIGS. 2 and 24, the differential size and spacing of the CMD yarn layers combined with the weave patterns of the MD yarns causes the MD yarns to create a zigzag pattern along the bottom layer of the fabric 1. For example, MD yarns 62 and 64 both weave under lower layer CMD yarn 41 while intermediate MD yarn 63 weaves over lower layer CMD yarn 41. As a result, MD yarns 62 and 64 gravitate toward each other under MD yarn 63. Similarly, throughout the repeat pattern, spaced MD yarns weave under a common lower CMD yarn while the intermediate MD yarns weave over that lower layer CMD yarn. This produces zigzagging of the MD yarns within the bottom layer of the fabric and promotes drainage through the fabric 1. While it is preferred to have only a single intermediate MD yarn, it is possible to have two or more intermediate yarns while maintaining the zig zag effect.

Referring to FIG. 24, the machine side surface has an irregular pattern of machine side MD knuckles 83, 85 with no defined diagonal. As a result, the fabric 1 is neutral with respect to guiding. That is, there is no defined diagonal pattern which will cause the fabric to drift in the direction of the diagonal as it travels on the papermaking machine. Instead, the fabric 1 is neutral and tends to run straight on the papermaking machine.

Also referring to FIG. 24, each lower layer CMD yarn 40–49 includes a float under eight MD yarns and a float under six MD yarns. For example, CMD yarn 45 floats under MD yarns 61–65 and MD yarns 69–76. The long CMD floats on the machine make the fabric 1 more wear resistant.

The MD yarns are preferably polyester monofilament yarns having a diameter of 0.0047 in. (0.12 mm). Preferably, the top layer CMD yarns are also polyester monofilament yarns having a diameter of 0.005 in. (0.127 mm). The lower layer CMD yarns are preferably larger, being monofilament polyester yarns having a diameter of 0.0079 in. (0.20 mm). The caliper of the preferred fabric is approximately 0.0276 in. (0.70 mm) with an air permeability of 525 cubic feet per minute. Although specific size yarns have been disclosed, the diameter of the MD yarns and the upper CMD yarns is generally in a range from 0.0025–0.032 in. (0.06–0.80 mm) and the diameter of the lower CMD yarns from 0.0035–0.050 in. (0.09–1.27 mm). Preferably the upper layer CMD yarns are in the range of 50%–90% of the diameter of the lower layer CMD yarns.

Although polyester, polyamide, fluropolymers yarns are preferred, it will be recognized by those of ordinary skill in the art that other types of yarns, including treated or coated yarns, may be employed where the demands of the specific application make other materials preferable.

The fabric preferably has an MD count of 185 yarns per inch and a CMD count of 150 yarns per inch, 100 yarns per inch in the upper layer and 50 yarns per inch in the lower layer. It is also preferred that the MD cover, the percentage of the space occupied by the MD yarns across the fabric, is between 80% and 100%. For example, with the preferred MD yarn size of 0.0047 in. woven at 185 yarns per inch, the MD cover is approximately 87%, i.e. 0.87 inches width of MD yarns per inch of fabric width.

Other variations within the scope and spirit of the invention will be apparent to those of ordinary skill in the art.

What is claimed is:

1. A papermaking fabric having a machine side and a paper side comprising:

a machine side layer of cross machine direction (CMD) yarns having a selected number of yarns per inch;

a paper side layer of CMD yarns having twice said selected number of yarns per inch; and a system of machine direction (MD) yarns interwoven with the CMD yarn layers in a repeat pattern, each MD yarn interwoven:

a) with respect to the paper side CMD layer to define first and second paper side knuckles with each paper side layer CMD yarn passed over by at least one MD paper side knuckle and a MD paper side knuckle over each paper side layer CMD yarn which is spaced in a first direction by "X", wherein "X" is an integer equal to or greater than one, MD yarns from a MD paper side knuckle over an adjacent paper side layer CMD yarn and spaced in a direction opposite the first direction by "X" MD yarns from a MD paper side knuckle over an oppositely adjacent paper side layer CMD yarn, b) with respect to the machine side CMD layer to define first and second machine side knuckles with each machine side layer CMD yarn passed under by two MD machine side knuckles spaced from each other by at least one intermediate MD yarn.

2. The fabric of claim 1 wherein the MD yarns zigzag on the machine side of the fabric.

3. The fabric of claim 1 wherein the MD yarns repeat on twenty yarns.

4. The fabric of claim 1 wherein the paper side layer CMD yarns repeat on twenty yarns and the machine side layer CMD yarns repeat on ten yarns.

5. The fabric of claim 1 wherein the MD yarns include first and second subsets of yarns.

6. The fabric of claim 5 wherein the second paper side knuckle of each first MD subset yarn is spaced from its first machine side knuckle by two machine side layer CMD yarns.

7. The fabric of claim 6 wherein each first MD subset yarn weaves in a repeated pattern of over a paper side layer CMD yarn, between the paper and machine side layers while passing under two adjacent paper side layer CMD yarns, over a paper side layer CMD yarn, between the paper and machine side layers while passing under four adjacent paper side layer CMD yarns, under a machine side layer CMD yarn, between the paper and machine side layers while passing under five adjacent paper side layer CMD yarns, under a lower layer CMD yarn and between the paper and machine side layers while passing under five adjacent paper side layer CMD yarns.

8. The fabric of claim 5 wherein the second paper side knuckle of each second MD subset yarn is spaced from its first machine side knuckle by three machine side layer CMD yarns.

9. The fabric of claim 8 wherein each second MD subset yarn weaves in a repeated pattern of under a machine side layer CMD yarn, between the paper and machine side layers while passing under five adjacent paper side layer CMD yarns, under a machine side layer CMD yarn, between the paper and machine side layers while passing under two adjacent paper side layer CMD yarns, over a paper side layer CMD yarn, between the paper and machine side layers while passing under two adjacent paper side layer CMD yarns, over a paper side layer CMD yarn and between the paper and machine side layers while passing under seven adjacent paper side layer CMD yarns.

10. The fabric of claim 1 wherein "X" equals two.

11. The fabric of claim 1 wherein "X" equals three.

12. The fabric of claim 1 wherein "X" is greater than three.

13. The fabric of claim 1 wherein the first paper side knuckle of a given MD yarn is spaced three MD yarns from the first paper side knuckle of an adjacent MD yarn.

14. The fabric of claim 1 wherein each paper side layer CMD yarn includes two distinct floats over at least eight MD yarns.

15. The fabric of claim 1 wherein each machine side layer CMD yarn includes two distinct floats under at least six MD yarns.

16. The fabric of claim 1 wherein the machine side MD knuckles are in a non-diagonal pattern.

17. The fabric of claim 1 wherein CMD yarns are circular and the paper side layer CMD yarns are in a range of 50 to 90 percent the diameter of the machine side layer CMD yarns.

18. The fabric of claim 1 wherein the MD cover is between 80 and 100 percent.

* * * * *